US005730161A

United States Patent [19]

Kohanek

[11] Patent Number: 5,730,161

[45] Date of Patent: Mar. 24, 1998

[54] METHOD AND APPARATUS FOR FORMING A HAIR FASTENER

[76] Inventor: Michael Kohanek, 338 1/2 S. Orange, Brea, Calif. 92621

[21] Appl. No.: 792,090

[22] Filed: Jan. 31, 1997

Related U.S. Application Data

[63] Continuation of Ser. No. 340,658, Nov. 16, 1994, abandoned.

[51] Int. Cl.[6] ..... A45D 8/04; A45D 8/34; A45D 8/36

[52] U.S. Cl. ..... 132/273; 132/222; 132/247; 132/212

[58] Field of Search ..... 132/222, 273, 132/275, 200, 212, 245, 246, 248, 247

[56] References Cited

U.S. PATENT DOCUMENTS

| | | | |
|---|---|---|---|
| 2,560,267 | 7/1951 | Baker et al. | 132/273 |
| 3,000,384 | 9/1961 | Piers, Jr. | 132/273 |
| 5,056,538 | 10/1991 | Matula | 132/222 |
| 5,184,274 | 2/1993 | Weiss | 361/220 |
| 5,293,884 | 3/1994 | Chapman et al. | 132/200 |
| 5,365,954 | 11/1994 | Rude | 132/273 |
| 5,411,040 | 5/1995 | Forrest | 132/222 |

*Primary Examiner*—John J. Wilson
*Assistant Examiner*—Pedro Philogene
*Attorney, Agent, or Firm*—Gene Scott, Patent Law & Venture Group

[57] ABSTRACT

A hair fastening device and a method of holding hair in place employing a device for holding hair inside an elongated, cylindrically shaped, hair fastener made from a flexible material. The hair fastener is formed from a single rectangular piece of flexible material having mating connectors formed on opposite, parallel sides of the material. The material is used to hold hair in place by sliding the material around the hair to be fastened. The hair fastener has hooking mechanism by which the fastener is held in place by attaching to a conventional hair fastening device.

6 Claims, 2 Drawing Sheets

METHOD AND APPARATUS FOR FORMING A HAIR FASTENER

This is a continuation of application Ser. No. 08/340,658, filed Nov. 16, 1994, now abandoned.

BACKGROUND OF THE INVENTION

1. Field of the Invention

The invention relates to hair fasteners, and more specifically fastening hair with hair fastening devices made from inexpensive materials that securely hold in place.

2. Description of the Prior Art

Numerous hair fastening devices have been disclosed by the prior art that teach varying means and methods of holding hair in a desired fashion. Typical among these teachings are plastic devices formed as combs or clamping devices.

U.S. Pat. No. Des. 323,907 issued to Andrade on Feb. 11, 1992 for a HAIR FASTENER (hereinafter referred to as "Andrade") disclosed a Hair Fastener formed from a comb like device having an ornamental design attached to the comb. While the disclosure of "Andrade" taught an ornamental Hair Fastener that was capable of holding hair, the hair so held by such a device could slip and the device itself could easily fall out of place. The disclosure of "Andrade" did not teach a or device that could remain securely in place without slipping.

U.S. Pat. Nos. 5,082,011 and 5,261,428 issued in 1992 and 1993, respectively to WU. These patents, each for a HAIR FASTENING DEVICE, are related applications of parent application number 568,981 (hereinafter collectively referred to as "Wu") which consisted of comb like supports with pinching teeth. While "Wu" taught devices that were capable of holding hair, no shaping of the hair was accomplished while the hair was being held in place.

U.S. Pat. No. 5,074,014 issued on Dec. 24, 1991 to Freeman for a TARP FASTENER (hereinafter referred to as "Freeman") disclosed a Tarp Fastener employing a hair pin like device to fasten tarp. While this device had no practical purpose for fastening hair, it did teach a methodology using hair pin like devices. However, no disclosure was made of a method or apparatus that would securely hold hair in place while providing a shapely contour to the hair.

U.S. Pat. No. 4,913,174 issued to Cusenza on Apr. 3, 1990 for a HAIR FASTENER (hereinafter referred to as "Cusenza") disclosed a clamping mechanism that functioned as a Hair Fastener. Individual strands of hair could be tightly clamped but no shape was intended or created in the resulting clamped hair.

Additionally, the prior art includes devices made from flexible material 1 in which hair is tied into a pony tail with an elastic band that is connected to the flexible material. The hair is held in place by wrapping the hair with the flexible band and using the velcro strips attached to the flexible material to form a short cylindrical shape. While providing a simple means to secure hair, the entire device slips easily and the flexible band provided with these devices lacks sufficient length to shape the hair. Moreover, the short cylindrical shape lacks esthetic appeal.

It should be apparent from the foregoing discussion, there remains a need within art of hair fasteners for a device that is capable of securing hair without slipping while simultaneously shaping that hair so held. It is these and other problems in the prior art that the present invention addresses.

SUMMARY OF THE INVENTION

The present invention is a hair fastening device that is intended to form a long, cylindrically shape hair retention device. The invention employs a flexible piece of material selected from either leather, neoprene or terry cloth formed in an essentially rectangular shape. The flexible piece of material is preferably formed such that it deviates from being square by having one pair of sides longer than the other. The invention employs connecting means formed on the longer sides to enable creation of the long cylindrical shape. The long, cylindrically shaped device is attached to the user by employing a novel method of attachment. The hair is tied using a conventional hair fastener. The hair fastener attaches to the conventional fastener via attachment means which in the preferred embodiment hook onto the conventional fastener.

It is an object of the present invention to create a hair fastening device that contours hair into a long, neatly held shape.

It is also an object of the present invention to create a hair fastening device that will fit securely upon a users hair and not slip during use.

It is also an object of the present invention to create a hair fastening device from inexpensive materials.

It is also an object of the present invention to create a hair fastening device that is easy to manufacture.

It is still further an object of the present invention to create teach a method of fastening hair which is simple to implement and still is effective in holding hair in place.

These and other objects of the invention will become apparent from the detailed description of the drawings

BRIEF DESCRIPTION OF THE DRAWINGS

FIG. 1*b*.

DETAILED DESCRIPTION OF THE PREFERRED EMBODIMENT

Figure 1A:
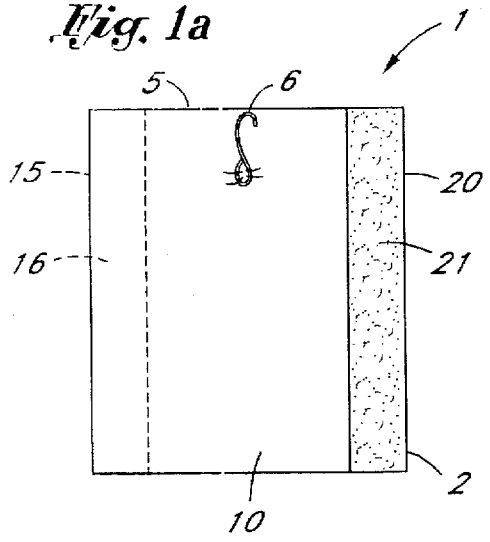
FIG. 1*a* is view of the present invention in an open position.

The present invention overcomes the shortcomings within the prior art devices such as those discussed above. Referring by It has been discovered that a hair fastening device formed in a long, cylindrical shape can contour hair and provide means for securing the hair fastening device to the hair. The invention as shown in FIG. 1*a*, and generally referred to as 1, employs a flexible piece of material 2 that be any of numerous materials. Preferably the material is selected from either leather, neoprene or terry cloth is formed into an essentially rectangular shape having a first end 5, second end 10, left side 15 and right side 20. The flexible piece of material is preferably formed such that it deviates from being square by left side 15 and right side 20 being longer than the edges defined by first end 5 and second end 10.

It is envisioned that the invention employ connecting means formed on the longer sides. The left side 15 and right side 20 therefore are constructed to have compatible fasteners that may be coupled together to create the long cylindrical shape from material 2. In the preferred methodology of employing the present invention, the basic operation of the device requires the user to use a conventional hair fastener to hold the hair in place while the present invention is then used to form a long cylindrical shape. Here, any conventional hair tie would suffice. However, the preference is to use a cloth coated type rubber band that can firmly create a pony tail while not breaking the individual hair fibers. Once the hair is fastened using a conventional hair fastener, the fastened hair is placed within the material 2 of the present invention such that it runs from first end 5 to second end 10, with first end 5 being closer to the scalp of the user. Hooking device 6 is then attached to the conventional cloth coated rubber band prior to engaging connecting means located at left side 15 and right side 20. This method yields a tightly held, long, cylindrical shape were the fastener is in place. Furthermore, the hair fastener 1 is held in place by hooking device 6.

Numerous connecting means are envisioned, however, velcro is the most preferred. By placing mating velcro strips along left side 15 and right side 20 running the length of the device from first end 5 to second end 10, left velcro strip 16 and right velcro strip 21 are formed. Other connecting means are envisioned, with ease of use and reduction of manufacturing costs being prime considerations into what is most preferred.

Figure 1B:
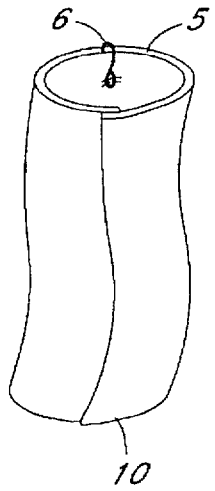
FIG. 1*b* is a view of the present invention in a closed position.

The most preferred embodiment is that shown in FIG. 1 using a neoprene material as flexible material 2 and velcro as the connecting means 16, 21. However, terry cloth or leather could equally function as flexible material 2. Hooking device 6 is embedded within flexible material 2 during the manufacturing process either by riveting or stitching.

Figure 1C:
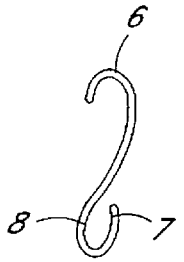
FIG. 1*c* is a view of the hooking device of FIG 1*a*.

The hooking device 6 used within the hair fastening device 1 is typically a thin cylindrical rod curved that forms an arcuate, hook like device. The hair fastening device 1 may also have a different means securing the hair fastening device 1 to a human other than the arcuate, hook like device. Other comb like devices, or hair pin devices are also envisioned to be used. However, a hook like mechanism is preferable for ease of use in firmly securing the hair fastening device 1 of the present invention to a conventional cloth covered rubber band. The hooking device further comprises means for attaching the hooking device 6 to the first end 5 of flexible material 2. Referring to FIG. 1*c*, here, some type attachment means 7 can be either a loop formed within the hooking device 6 or attachment means 7 can be a flat portion that defines a central aperture 8. Either of these configurations can function for both stitching and riveting purposes.

The hair fastening 1 having as flexible material 2 either leather, neoprene or terry cloth can all employ a hooking device being either stitched or riveted to the flexible material. Velcro strips can also be used as connecting means 16, 21. However, usage of leather as flexible material 2 makes the usage of velcro strips as connecting means 16, 21 somewhat more difficult.

Figure 2A:
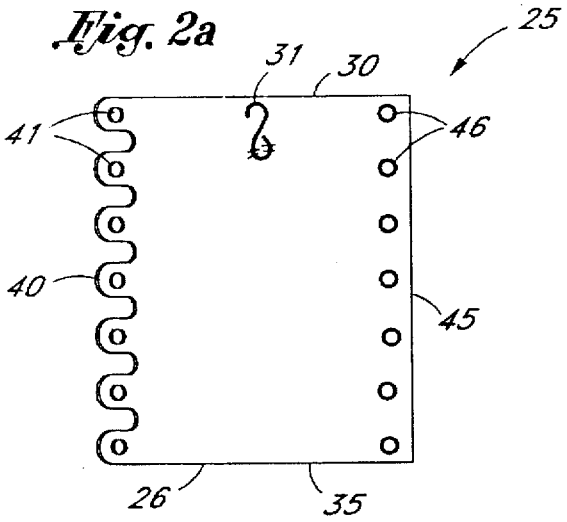
FIG. 2*a* is a view of the present invention in an open position.
Figure 2B:
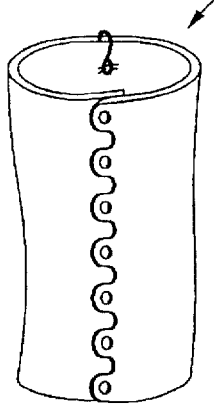
FIG. 2*b* is a view of the present invention in a closed position.

Referring now to FIG. 2, the hair fastening device generally referred to as 25, is constructed from a flexible material 26 that is in this embodiment most preferably leather. As in the previous embodiment, the flexible material 26 is cut into an essentially rectangular shape having a first end 30, second end 35, left side 40 and right side 45. The left and right sides 35, 40 are made longer than the first and second ends 30, 35 to facilitate the creation of a long, cylindrically shaped hair fastening device. In a leather embodiment, it is preferred that connecting means be formed from male snaps 41 on left side 40 being arranged along the length of 40 left side with compatible female snaps 46 being arranged along the length of right side 45 such that the hair fastening device 25 can be firmly closed upon human hair. Again the hair is fastened by a conventional hair fastening device such a cloth covered rubber band as discussed above. Also a hooking device 31 is used to attach the entire fastener to the conventional hair fastener. Instead of a hooking device 31, hair pin devices and small hair combs may also be used. However, the hooking device 31 is preferred due to cost and manufacturing considerations as well as ease and effectiveness of use.

The hair fastening device 25 shown if FIG. 2 can be made form a flexible material 26 is neoprene or terry cloth and the connecting means 41, 46 being made from snaps. However, leather is preferred for the embodiment shown in FIG. 2.

Figure 3A:
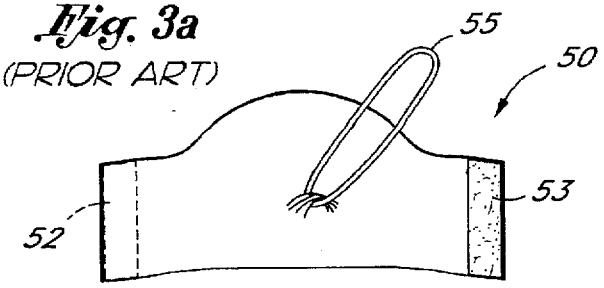
Fig. 3a (PRIOR ART)
FIG. 3*a* is a view of the prior in a open position.
Figure 3B:
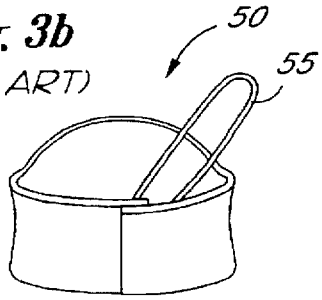
Fig. 3b (PRIOR ART)
FIG. 3*b* is a view of the prior art in a closed position.

The method for fastening hair taught by the present invention offers improvements over prior art devices in a number of ways. The long cylindrical shape of the hair fastening device of the present invention provides a high degree of artistic beauty to the hair thus fastened. Prior art devices such as those shown in FIG. 3, generally referred to as 50 provide a flexible material 51 that can be fastened using securing device 55, which is essentially a rubber band or elastic hair fastener. Here, the securing device 55 is used to create a pony tail in the hair of the user and hair fastening device 50 is then wrapped around that pony tail.

This configuration has many disadvantages in view of the present invention. Among these is the simple fact that eventually the securing device will breaking and the entire hair fastener will become useless. Typically, elastic or rubber bands are employed as securing device 55 which undesirable compared to cloth covered rubber bands that will not break or damage the hair. If the securing device does not break the elasticity will eventually diminish preventing the device from remaining in place. The entire prior art mechanism shown in FIG. 3 creates a short cylindrically shaped fastener when in use. This will not capture enough hair to actually shape the hair as does the long cylindrical shape of the present invention. Furthermore, the present invention can be cut to a length that is desired by the user. and this is not possible with the prior art device shown in FIG. 3.

The method of the present invention uses a hooking device that will not wear over time. Also the present invention creates a more attractive shape to the hair. Prior art devices simply grab a small cross section of hair and hold that section. The present invention holds a substantial length of hair tightly creating an extremely neat appearance.

Figure 4:
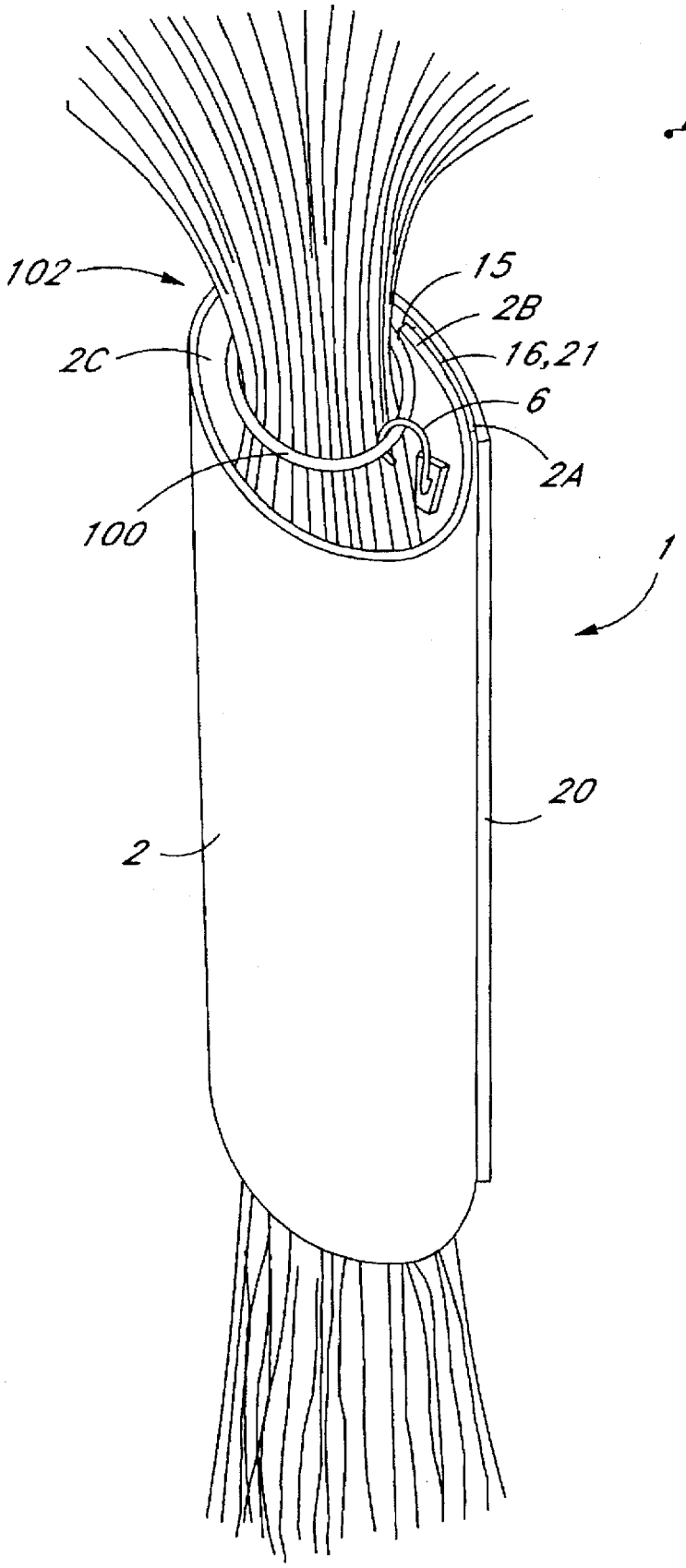
FIG. 4 is a perspective view of the invention shown engaged with a pony tail.

The hair fastening device 1 preferably holds a plurality of hair strands, as shown in FIG. 4, as an elongate hair bundle 102. The device 1 comprises a combination of two elements which cooperate to achieve the advantages, objectives and benefits of the invention as further described below.

A pony tail holder 100 comprises a flexible coil preferably of a resilient material, the holder 100 encircling and clamping the hair bundle 102 as shown in FIG. 4.

A flexible sheet 2 provides a pair of opposing edges 15 and 20, also described as "sides" above, and adjacent to the edges 15, 20 a means for removably interconnecting 16 and 21 the edges 15, 20 so as to hold the sheet 2 as a tube, the tube encircling the hair bundle 102 as best seen in FIG. 4. The interconnecting means 16 and 21 are, as shown in FIG. 1*a*, preferably a hook and loop surface fastener material such as Velcro® or its equivalent. An interior annular surface 2C of the tube restrains the hair bundle 102. In the preferred embodiment, the opposing edges 15, 20 overlap to form an outer flap 2A and an inner flap 2B sandwiching the interconnecting means 16, 21 between them.

The interior annular surface 2C provides an attachment means 6, as described above and preferably in the shape of a simple hook shaped wire, on the inner flap 2B and fixed thereto adjacent to an end of the tube 5, the attachment means 6 being removably engaged with the pony tail holder 100 to maintain a fixed relationship between the tube and the hair bundle 102. This, of course, is critical in that the tube will slide along the hair bundle 102 unless it is anchored. The combination of the pony tail holder 100 and the tube are uniquely able, in their novel interaction, to direct the hair bundle 102 while maintaining their physical relationship to it. This forms the basis for novelty in structure as well as unique capability in meeting the objectives defined above, in the present invention.

The detailed description has disclosed those embodiments most preferred by the inventor. However, the course and scope of the invention should be measured not just by these most disclosed embodiments but by the appended claims.

What is claimed is:

1. A hair fastening device for holding a plurality of hair strands as an elongate hair bundle, the device comprising in combination:

a pony tail holder comprising a flexible coil of a resilient material, the holder encircling and clamping the hair bundle; and a flexible sheet providing a pair of opposing edges and adjacent to the edges a means for removably interconnecting the edges so as to hold the sheet as a tube, the tube encircling the hair bundle, an interior annular surface of the tube restraining the hair bundle;

the interior annular surface providing an attachment means fixed thereto adjacent an end of the tube, the attachment means being removably engaged with the pony tail holder to maintain a fixed relationship between the tube and the hair bundle.

2. The device of claim 1 wherein the attachment means is hook shaped.

3. The device of claim 1 wherein the interconnecting means is a hook and loop surface fastener material.

4. A hair fastening device for holding a plurality of hair strands as an elongate hair bundle, the device comprising in combination:

a pony tail holder comprising a flexible coil of a resilient material, the holder encircling and clamping the hair bundle; and a flexible sheet providing a pair of opposing edges and adjacent to the edges a means for removably interconnecting the edges so as to hold the sheet as a tube, the tube encircling the hair bundle, an interior annular surface of the tube restraining the hair bundle;

the opposing edges overlapping to form an outer flap and an inner flap sandwiching the interconnecting means therebetween;

the interior annular surface providing an attachment means on the inner flap and fixed thereto adjacent an end of the tube, the attachment means being removably engaged with the pony tail holder to maintain a fixed relationship between the tube and the hair bundle.

5. The device of claim 4 wherein the attachment means is hook shaped.

6. The device of claim 4 wherein the interconnecting means is a hook and loop surface fastener material.

* * * * *